US008113163B2

(12) United States Patent
Clever et al.

(10) Patent No.: US 8,113,163 B2
(45) Date of Patent: Feb. 14, 2012

(54) CONCENTRIC CAMSHAFT AND METHOD OF ASSEMBLY

(75) Inventors: Glenn E. Clever, Washington, MI (US); Roy Glenn Kaywood, Jackson, MI (US)

(73) Assignee: GM Global Technology Operations LLC

( * ) Notice: Subject to any disclaimer, the term of this patent is extended or adjusted under 35 U.S.C. 154(b) by 445 days.

(21) Appl. No.: 12/400,265

(22) Filed: Mar. 9, 2009

(65) Prior Publication Data

US 2010/0224147 A1 Sep. 9, 2010

(51) Int. Cl.
*F01L 1/04* (2006.01)

(52) U.S. Cl. ..... 123/90.6; 123/90.16; 123/90.44; 29/888.1

(58) Field of Classification Search ..... 123/90.16, 123/90.6, 90.44; 29/888.1
See application file for complete search history.

(56) References Cited

FOREIGN PATENT DOCUMENTS

JP 60009803 A * 1/1985

* cited by examiner

*Primary Examiner* — Ching Chang
(74) *Attorney, Agent, or Firm* — Harness, Dickey & Pierce, P.L.C.

(57) ABSTRACT

A camshaft may include a first shaft, a stop member, and a first lobe member. The first shaft may include an outer radial surface having a first recess extending radially therein. The stop member may be axially fixed within the first recess. The first lobe member may define an inner bore located on the outer radial surface of the first shaft. The first lobe member may include a second recess extending radially into the inner bore. The stop member may extend into the second recess to axially locate the first lobe member on the first shaft.

20 Claims, 6 Drawing Sheets

CONCENTRIC CAMSHAFT AND METHOD OF ASSEMBLY

FIELD

The present disclosure relates to engine camshaft assemblies.

BACKGROUND

This section provides background information related to the present disclosure which is not necessarily prior art.

Engines typically include a camshaft to actuate intake and exhaust valves. Some camshafts are concentric camshafts that provide for relative rotation between, for example, the intake and exhaust lobes. The intake lobes may be fixed to an outer shaft for rotation with the shaft and the exhaust lobes may be rotatably supported on the shaft. Alternatively, the exhaust lobes may be fixed to the outer shaft for rotation with the shaft and the intake lobes may be rotatably supported on the shaft. In any arrangement, the lobes that are rotationally fixed on the outer shaft may be axially and rotationally located on the outer shaft in a predetermined orientation before being fixed thereto. The locating may include engaging an outer radial surface of the lobe, necessitating further machining of the lobe.

SUMMARY

This section provides a general summary of the disclosure, and is not comprehensive of its full scope or all of its features.

A camshaft may include a first shaft, a stop member, and a first lobe member. The first shaft may include an outer radial surface having a first recess extending radially therein. The stop member may be axially fixed within the first recess. The first lobe member may define an inner bore located on the outer radial surface of the first shaft. The first lobe member may include a second recess extending radially into the inner bore. The stop member may extend into the second recess to axially locate the first lobe member on the first shaft.

The camshaft may be included in an engine assembly and may be rotatably supported on an engine structure.

A method of locating a cam lobe member on a camshaft may include forming a first recess in an outer radial surface of a first shaft of the camshaft. A stop member may be secured axially within the first recess. The lobe member may be located axially on the outer radial surface of the first shaft. The stop member may be received within a second recess located in an inner bore of the lobe member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
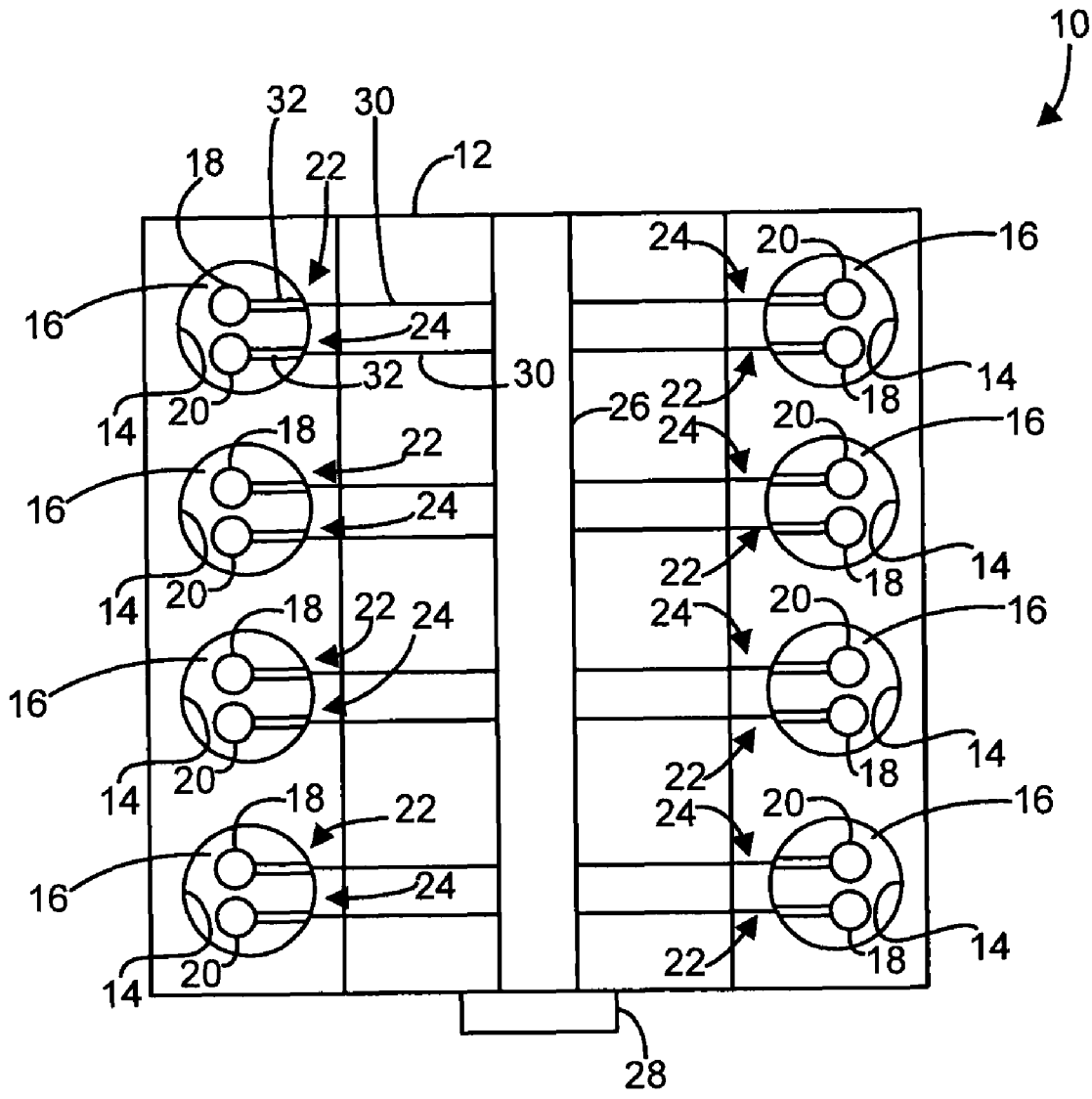
FIG. 1 is a schematic illustration of an engine assembly according to the present disclosure.

Referring now to FIG. 1, an exemplary engine assembly 10 is schematically illustrated. The engine assembly 10 may include an engine 12 including a plurality of cylinders 14 having pistons 16 disposed therein. The engine 12 may further include an intake valve 18, an exhaust valve 20, and intake and exhaust valve lift mechanisms 22, 24 for each cylinder 14, as well as a camshaft 26 and a cam phaser 28.

The intake valve lift mechanism 22 may include a pushrod 30 and a rocker arm 32. The exhaust valve lift mechanism 24 may additionally include a pushrod 30 and a rocker arm 32. Pushrods 30 may be engaged with the camshaft 26 to actuate the rocker arms 32 and selectively open the intake and exhaust valves 18, 20. While the engine assembly 10 is illustrated as a pushrod engine, it is understood that the present disclosure is not limited to pushrod engines and may be applicable to a variety of other engine configurations as well, such as overhead cam engines.

With reference to FIGS. 2-6, the camshaft 26 may include first and second shafts 34, 36, a first set of lobe members 38, 40, 42, 44, 46, a second set of lobe members 48, 50, 52, 54, and fasteners 56. In the present example, the first set of lobe members 38, 40, 42, 44, 46 may form an intake lobe set and the second set of lobe members 48, 50, 52, 54 may form an exhaust lobe set. However, it is understood that alternate arrangements may be provided where the first set of lobe members 38, 40, 42, 44, 46 may form an exhaust lobe set and the second set of lobe members 48, 50, 52, 54 may form an intake lobe set. Further, each of the first and second sets of lobe members 38, 40, 42, 44, 46, 48, 50, 52, 54 are not limited to only intake or exhaust valves. For example, the first and second sets of lobe members 38, 40, 42, 44, 46, 48, 50, 52, 54 may each include an intake lobe and/or an exhaust lobe. The first shaft 34 may be fixed for rotation with a first phaser member 58 and the second shaft 36 may be fixed for rotation with a second phaser member 60. The first and second phaser members 58, 60 may be rotatable relative to one another and relative to a rotationally driven member 62 of the phaser 28.

The first shaft 34 may include an annular wall 64 defining an inner bore 66. The second shaft 36 may be rotatably disposed within the inner bore 66 of the first shaft 34. The first shaft 34 may include slots 68 and recesses 70 (seen in FIGS. 4 and 6) therethrough and the second shaft 36 may include apertures 72 (seen in FIG. 3) that receive the fasteners 56 therein and couple the second set of lobe members 48, 50, 52, 54 for rotation with the second shaft 36. The slots 68 may form radial bores through the first shaft 34 and the apertures 72 may form radial bores through the second shaft 36. The slots 68 in the first shaft 34 may generally allow for a rotational travel of the fasteners 56 therein.

Figure 2:
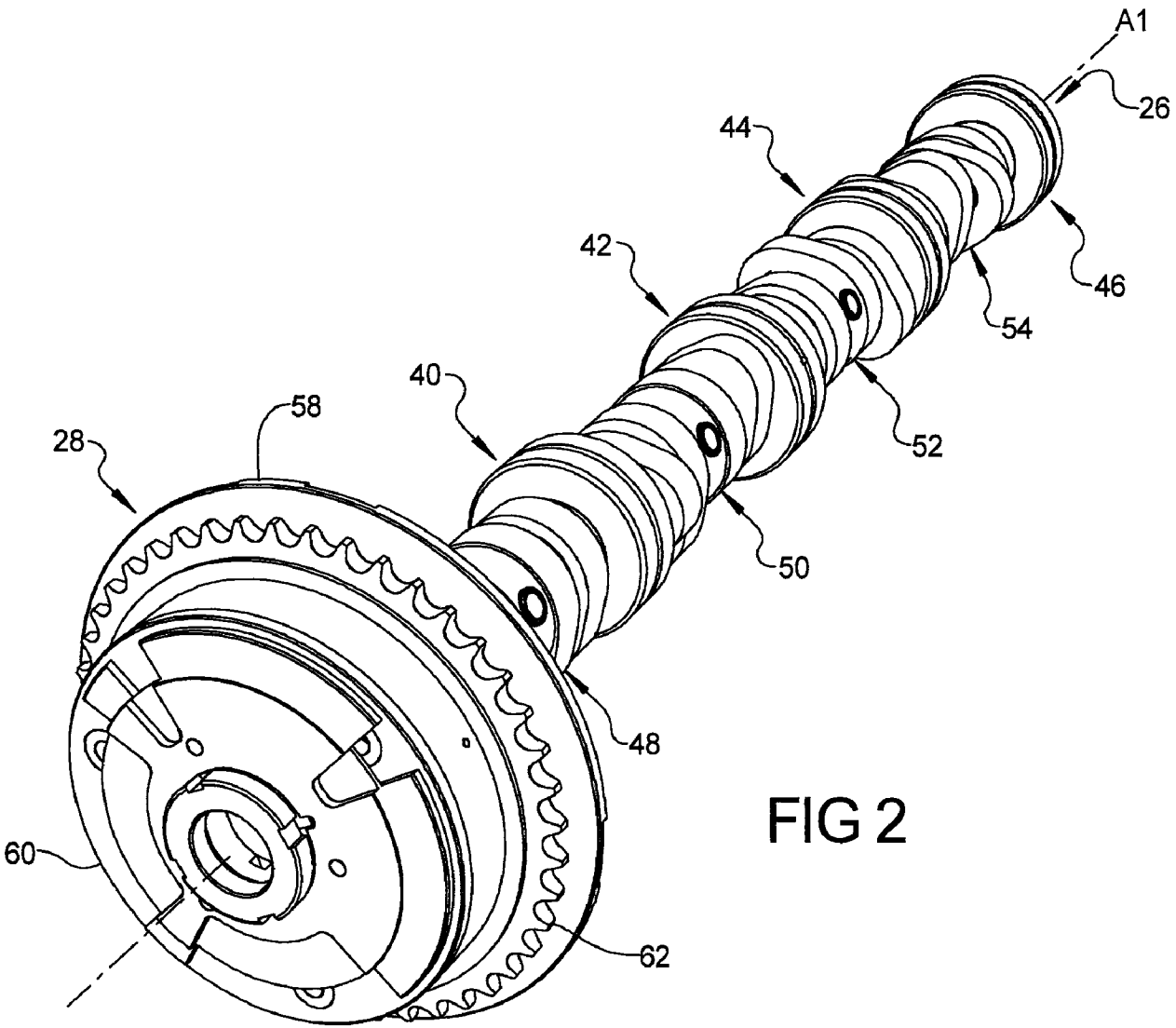
FIG. 2 is a perspective view of the camshaft and cam phaser of FIG. 1.
Figure 3:
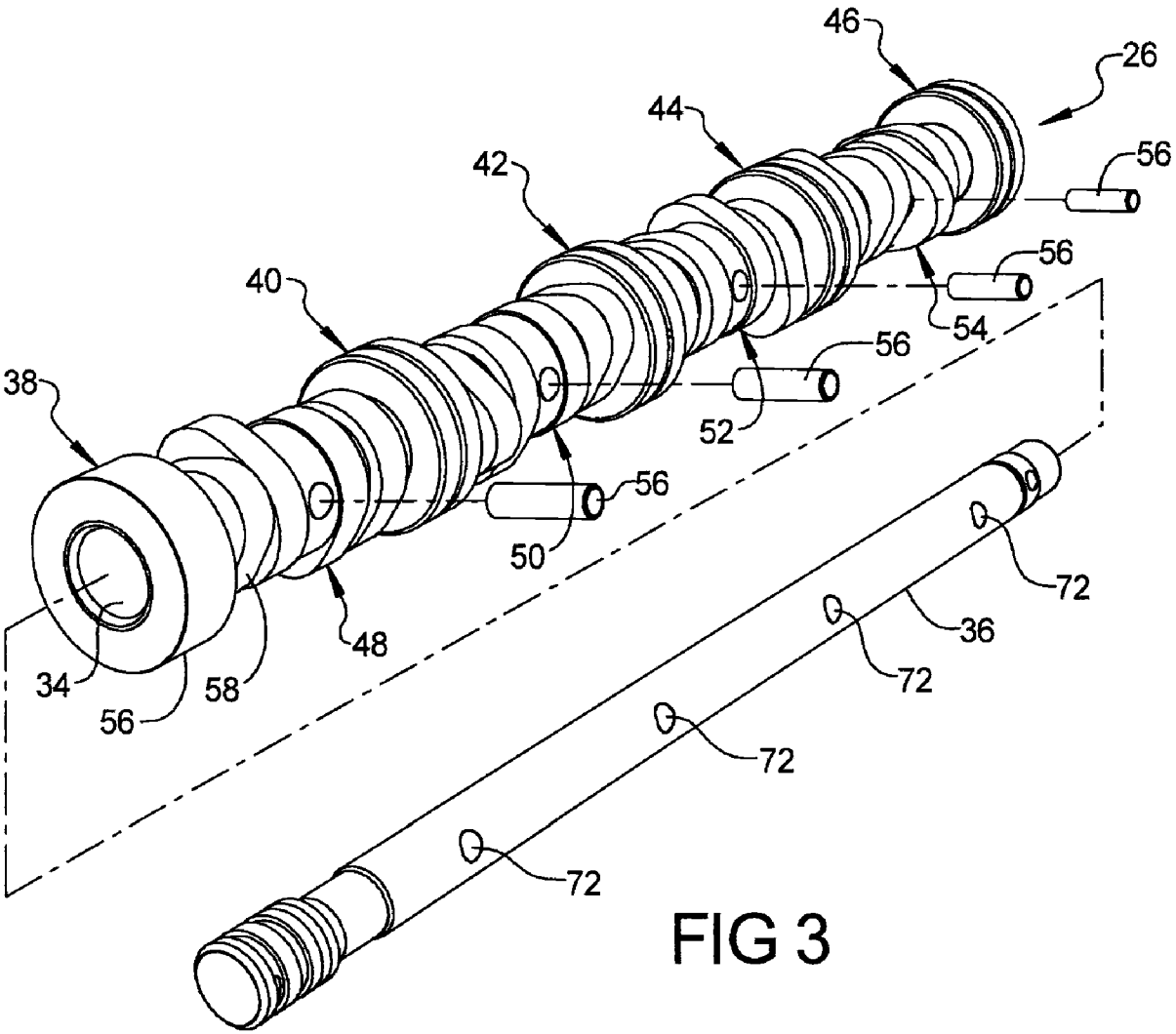
FIG. 3 is a perspective exploded view of the camshaft of FIG. 1.
Figure 4:
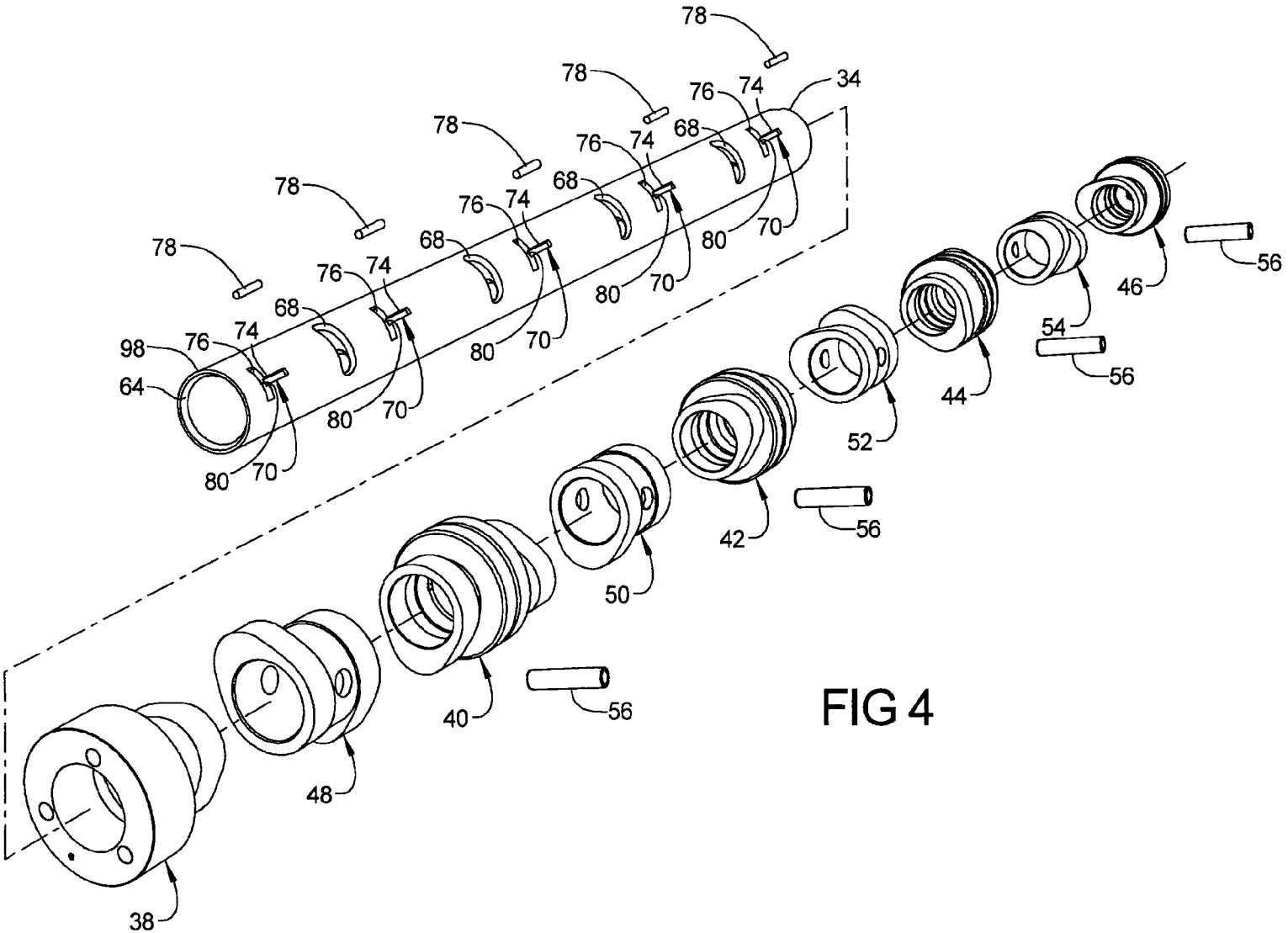
FIG. 4 is an additional perspective exploded view of the camshaft of FIG. 1.
Figure 5:
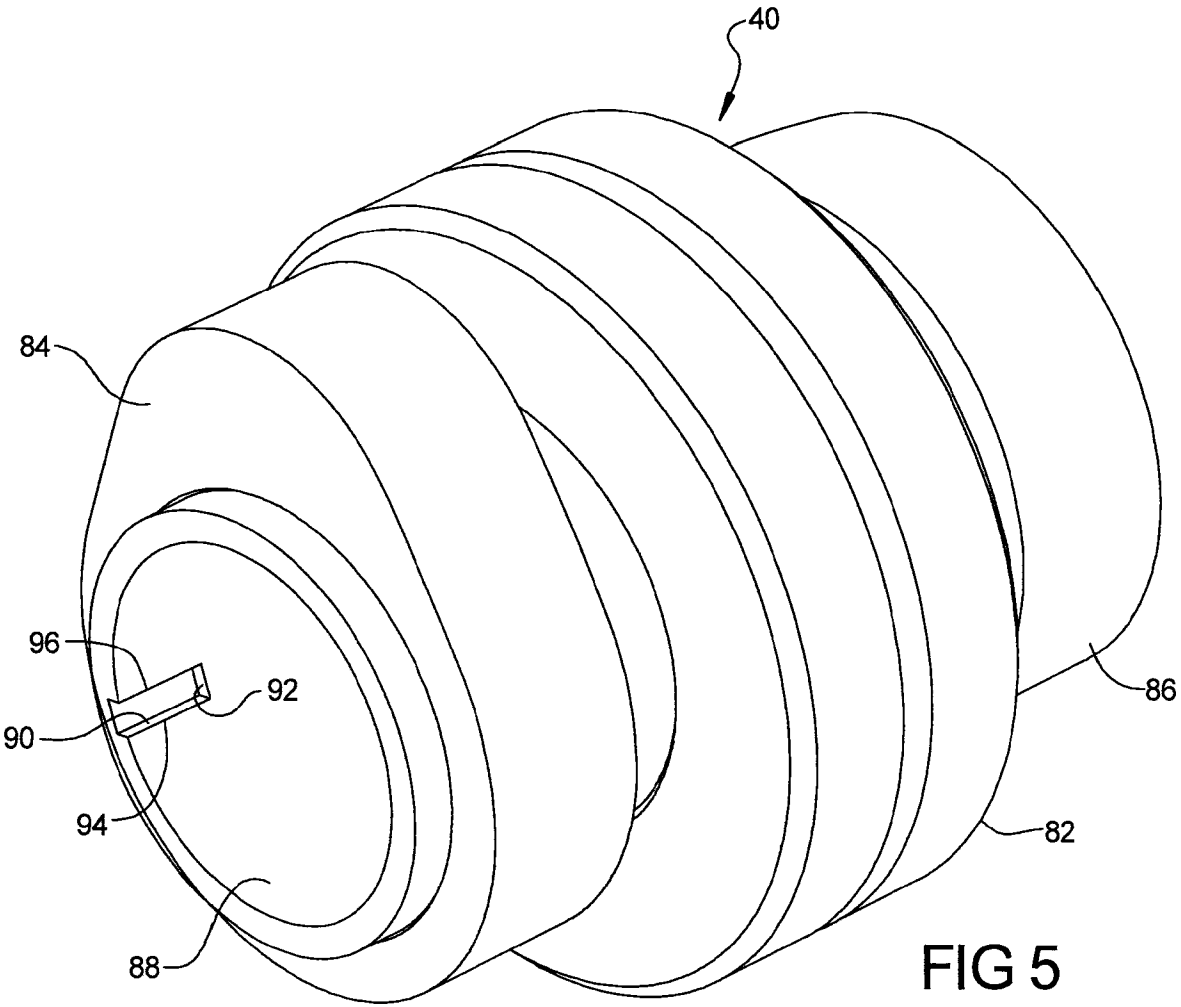
FIG. 5 is a perspective view of a lobe member of the camshaft of FIG. 1.
Figure 6:
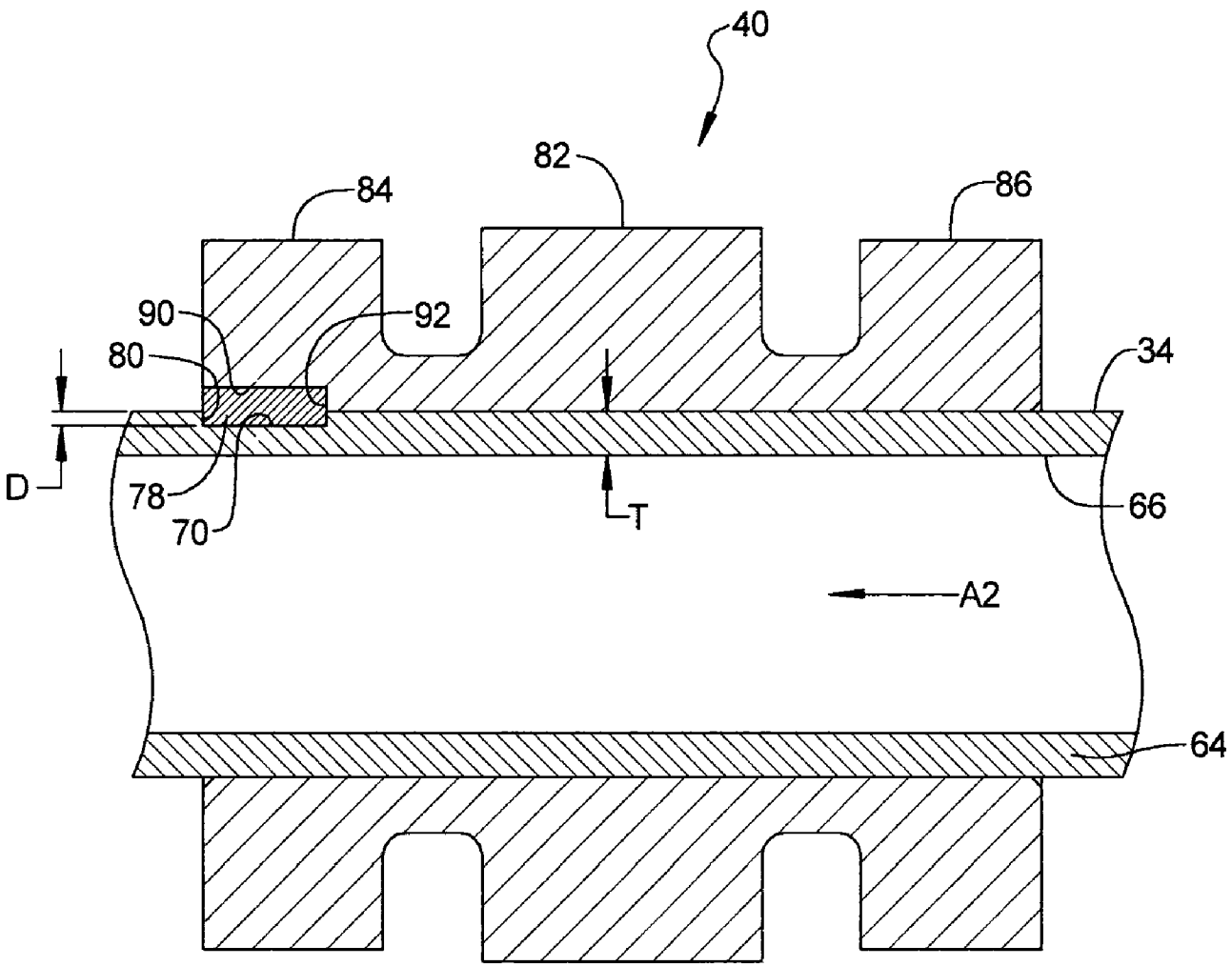
FIG. 6 is a fragmentary section view of the camshaft of FIG. 1.

As seen in FIG. 6, the recesses 70 may have a depth (D) less than a wall thickness (T) of the annular wall 64 of the first shaft 34. The recesses 70 may each include first and second portions 74, 76. The first portion 74 may extend generally parallel to a rotational axis (A1) of the camshaft 26, as seen in FIG. 2. The second portion 76 may extend generally perpendicular to the first portion 74 and may intersect a first end of the first portion 74. Stop members 78 may be located within the recesses 70 to axially locate the first set of lobe members 38, 40, 42, 44, 46. Each of the stop members 78 may include a generally longitudinal body extending within the first portion 74 of the recesses 70 and abutting a wall 80 defined by the second portions 76. The engagement between the stop members 78 and the walls 80 may axially fix the stop members 78 within the recesses 70.

The first set of lobe members 38, 40, 42, 44, 46 may engage the stop members 78 to axially locate and rotationally fix the first set of lobe members 38, 40, 42, 44, 46 on an outer radial surface of the first shaft 34. The engagement between each of the lobe members 38, 40, 42, 44, 46 and the stop members 78 may be generally similar, therefore lobe member 40 will be discussed in detail with the understanding that the description applies equally to lobe members 38, 42, 44, 46.

The lobe member 40 may include a journal portion 82 and first and second lobes 84, 86. The journal portion 82 and the first and second lobes 84, 86 may be rotationally fixed relative to one another. The lobe member 40 may define an inner bore 88 supported on the outer radial surface of the first shaft 34. The inner bore 88 may include a recess 90 extending into a first end thereof. The recess 90 may include an axial end stop 92 and first and second side walls 94, 96.

During assembly, the lobe member 40 may be displaced axially along the outer radial surface of the first shaft 34 in a direction (A2) seen in FIG. 6. The recess 90 in the bore 88 of the lobe member 40 may be rotationally aligned with the stop member 78. The lobe member 40 may be advanced axially along the first shaft 34 until the stop member 78 is received within the recess 90 and abuts the axial end stop 92 therein, axially locating the lobe member 40 relative to the stop member 78. Since the stop member 78 is axially fixed relative to the wall 80 defined by the recess 70, the lobe member 40 may be axially fixed relative to the wall 80 of the recess 70 as well. In addition to axially locating the lobe member 40, the stop member 78 may additionally rotationally fix the lobe member 40 relative to the first shaft 34. More specifically, the stop member 78 may be rotationally fixed within the first portion 74 of the recess 70. The stop member 78 may be secured between walls 94, 96 of the recess 90 in the lobe member 40, limiting rotation between the lobe member 40 and the first shaft 34.

By way of non-limiting example, the stop members 78 may be secured within the recesses 70 in a variety of ways including an interference fit engagement. The stop member 78 may be located within the recesses 70 as the first and second sets of lobe members 38, 40, 42, 44, 46, 48, 50, 52, 54 are located on the outer radial surface of the first shaft 34. More specifically, a first stop member 78 may be located within a first of the recesses 70 at a first end 98 of the first shaft 34. After the stop member 78 is secured within the recess 70, the lobe member 38 may be advanced axially along the first shaft 34 in the direction (A2) until engaged with the stop member 78 as discussed above.

Next, the lobe member 48 may be advanced axially along the first shaft 34 and axially fixed relative thereto by the fastener 56. Once the lobe member 48 has been advanced past the adjacent recess 70, another stop member 78 may be located in the recess 70 and the lobe member 40 may be placed on the first shaft 34 and advanced axially until engaged with the stop member 78. The process may be continued, alternating between the first and second sets of lobe members 38, 40, 42, 44, 46, 48, 50, 52, 54 until each of the lobe members are located on the first shaft 34.

The use of the stop member 78 in the recesses 70, 90 may eliminate the need for machining the outer surfaces of the lobe members after assembly. Specifically, during the location of the first set of lobe members 38, 40, 42, 44, 46 on the first shaft 34, outer radial surfaces of the lobe members may be free from engagement with a tool. Rather, an axial end surface may be engaged by a tool to advance the lobe members along the first shaft 34.

Additionally, as discussed above, the stop members 78 may rotationally fix the first set of lobe members 38, 40, 42, 44, 46 relative to the first shaft 34, reducing the requirements for an additional assembly method used to axially and rotationally fix the first set of lobe members 38, 40, 42, 44, 46 to the first shaft 34. For example, if a ballizing process is used to fix the first set of lobe members 38, 40, 42, 44, 46 to the first shaft 34, a lower deformation requirement of the first shaft 34 may be acceptable. Alternatively, if a shrink fit process is used to fix the first set of lobe members 38, 40, 42, 44, 46 to the first shaft 34, interference fit requirements may be relaxed as well. The stop members 78 may generally reduce the torque-to-turn requirement for a ballizing or shrink fit processes, as the stop members 78 may generally provide the desired torque-to-turn specification.

While discussed as a concentric camshaft, it is understood that the present disclosure is not limited to concentric camshafts and applies equally to fixed-lobe camshafts.

What is claimed is:

1. A camshaft comprising:

a first shaft including an outer radial surface and a first recess extending radially into the outer radial surface;

a stop member axially fixed within the first recess; and a first lobe member defining an inner bore located on the outer radial surface of the first shaft, the first lobe member including a second recess extending radially into the inner bore, the stop member extending into the second recess to axially locate the first lobe member on the first shaft, the second recess extending axially into a first end of the inner bore of the first lobe member and the stop member abutting an axial end surface of the second recess to axially fix the first lobe member relative to the first shaft.

2. The camshaft of claim 1, wherein the stop member abuts an axial end surface of the first recess to axially fix the stop member therein.

3. The camshaft of claim 2, wherein the first recess includes first and second portions, the first portion extending parallel to a rotational axis of the first shaft and the second portion extending generally perpendicular to and intersecting the first portion at an end of the first portion.

4. The camshaft of claim 3, wherein the stop member abuts a wall of the second portion to axially locate the stop member on the first shaft.

5. The camshaft of claim 1, wherein the stop member is rotationally secured within the first recess and rotationally fixes the first lobe member relative to first shaft.

6. The camshaft of claim 1, wherein the first recess has a radial depth less than a wall thickness of the first shaft.

7. The camshaft of claim 1, wherein the stop member includes an elongate pin extending generally parallel to the rotational axis of the first shaft.

8. The camshaft of claim 1, further comprising a second shaft and a second lobe member, the first shaft including an annular wall defining an axially extending bore and the second shaft being rotatably disposed within the axially extending bore, the second lobe member being rotatably supported on the outer radial surface of the first shaft and fixed for rotation with the second shaft.

9. An engine assembly comprising:

an engine structure; and a camshaft rotatably supported on the engine structure and including:

a first shaft including an outer radial surface and a first recess extending radially into the outer radial surface;

a stop member axially fixed within the first recess; and a first lobe member defining an inner bore located on the outer radial surface of the first shaft, the first lobe member including a second recess extending radially into the inner bore, the stop member extending into the second recess to axially locate the first lobe member on the first shaft, the second recess extending axially into a first end of the inner bore of the first lobe member and the stop member abutting an axial end surface of the second recess to axially fix the first lobe member relative to the first shaft.

10. The engine assembly of claim 9, wherein the stop member includes an elongate pin extending generally parallel to the rotational axis of the first shaft.

11. The engine assembly of claim 9, further comprising a second shaft and a second lobe member, the first shaft including an annular wall defining an axially extending bore and the second shaft being rotatably disposed within the axially extending bore, the second lobe member being rotatably supported on the outer radial surface of the first shaft and fixed for rotation with the second shaft.

12. A method comprising:

forming a first recess in an outer radial surface of a first shaft of a camshaft;

securing a stop member axially within the first recess; and locating a first lobe member axially on the outer radial surface of the first shaft, the locating including a second recess in an inner bore of the first lobe member receiving the stop member therein, the stop member abutting an axial end surface of the second recess to axially fix the first lobe member relative to the first shaft.

13. The method of claim 12, wherein the securing includes the stop member abutting an axial end surface of the first recess.

14. The method of claim 13, wherein the forming includes forming first and second portions of the first recess, the first portion including a channel extending parallel to a rotational axis of the first shaft and the second portion extending generally perpendicular to the first portion, the second portion intersecting the first portion at an end of the first portion and defining axial end stop for the stop member.

15. The method of claim 12, wherein the securing the stop member includes rotationally fixing the stop member relative to first shaft.

16. The method of claim 15, wherein the locating includes fixing the first lobe member for rotation with the first shaft.

17. The method of claim 12, wherein the locating includes axially displacing the first lobe member along the outer radial surface of the first shaft and onto the stop member.

18. The method of claim 17, wherein the locating includes displacing the first lobe member without engaging an outer radial surface of first lobe member.

19. The method of claim 12, further comprising locating a second shaft within an axial bore of the first shaft for rotation therein, locating a second lobe member on the first shaft for rotation relative thereto and fixing the second lobe member for rotation with the second shaft.

20. The method of claim 12, wherein the securing occurs before the locating.

* * * * *